United States Patent [19]

Baudis et al.

[11] Patent Number: 4,610,437

[45] Date of Patent: Sep. 9, 1986

[54] CRUCIBLE FOR HOLDING SALT BATHS FOR THE BORIDING OF STEELS

[75] Inventors: Ulrich Baudis, Hanau; Peter Biberbach; Rainer Engelmann, both of Rodenbach, all of Fed. Rep. of Germany

[73] Assignee: Degussa Aktiengesellschaft, Frankfurt, Fed. Rep. of Germany

[21] Appl. No.: 630,303

[22] Filed: Jul. 12, 1984

[30] Foreign Application Priority Data

Aug. 5, 1983 [DE] Fed. Rep. of Germany ..... 3328355

[51] Int. Cl.[4] ..... C22C 38/40; F27B 14/00

[52] U.S. Cl. ..... 266/275; 422/102; 432/265; 420/50; 420/55; 420/43; 420/56; 420/62; 420/34; 420/97; 420/112

[58] Field of Search ..... 266/275, 242, 280; 432/262, 265; 422/102; 156/DIG. 83; 75/124 C, 124 F, 128 R, 128 C; 148/6.14 A, 37, 38; 420/584

[56] References Cited

U.S. PATENT DOCUMENTS 3,107,997 7/1961 Kozlik et al. ..... 75/124 C

FOREIGN PATENT DOCUMENTS 2416262 10/1974 Fed. Rep. of Germany ..... 266/275
2717195 11/1978 Fed. Rep. of Germany ..... 266/275
57-19363 2/1982 Japan ..... 75/128 C

*Primary Examiner*—L. Dewayne Rutledge
*Assistant Examiner*—Deborah Yee
*Attorney, Agent, or Firm*—Cushman, Darby & Cushman

[57] ABSTRACT

There is provided a crucible for containing salt baths for the boriding of steels which has a high service life made of a steel which consists of (or consists essentially of) 0.05–0.8% carbon, 0.8–2.5% silicon, 0.1–2.0% manganese, 0–1.5% aluminum, 6–30% chromium, 4–39% nickel and the balance iron.

8 Claims, No Drawings

CRUCIBLE FOR HOLDING SALT BATHS FOR THE BORIDING OF STEELS

BACKGROUND OF THE INVENTION

The invention is directed to a crucible for containing salt baths used for the boriding of steels. The boriding of steel is a relatively young process whose significance has grown considerably in recent years. For boriding, the steel parts are immersed in boron supplying salt melts and annealed for several hours at 850°-950° C. Thereby there is built up a hard, wear resistant layer of iron boride ($Fe_2B$) through diffusion of boron into the steel surface.

The boriding salt melts can be operated in the air and it is sufficient for purpose of the treatment to immerse in the melt the parts secured on the charge frame, withdraw the parts after completing the boriding, quenching in water and rinse off the salt residues.

However, great industrial use of this simple boriding process thus far has been retarded by the considerable corrosion problems with crucibles used for containing the salt baths. Generally the boriding salt melts consist of a mixture of alkali and alkaline earth metal chlorides, e.g. sodium chloride, potassium chloride, barium chloride or calcium chloride, alkali and alkaline earth metal fluorides, e.g. sodium fluoride, potassium fluoride, barium fluoride or calcium fluoride, boron oxide and borates, e.g. borax or sodium metaborate, as well as a boriding agent, for the most part boron carbide or boron powder. These melts are operated at 850°-950° C. Thereby especially the fluorides and the borates very quickly cause corrosion of crucibles made of normal steels. Thus customary crucibles of carbon steel or low alloyed steels, as are customarily used in the hardening art, only withstand the corrosion attack of the boriding salt melt for several weeks. In this case, in the first place the corrosion depends on an oxidative corrosion of the crucible material which corrosion is greatly accelerated by the oxide dissolving and corroding action of the fluoride and borate. Therefore there have already been attempts to use as the material for the crucible corrosion resistant, high nickel containing special alloys based on nickel-chromium having nickel contents of 50-90 wt. % and chromium contents of 13-23 wt. % as well as small amounts of aluminum, cobalt, iron, manganese, titanium, tungsten, and molybdenum or even of pure nickel.

However, these materials are likewise quickly corroded by boriding salt melts. High alloyed, corrosion resistant steels, such as the known VA-steels, likewise are unusable as crucible material. They are corroded both by the attack of the boriding agent and also corroded by the attack of the oxide dissolving borate and fluoride. The titanium crucibles occasionally used in the art are not resistant to fluorides and other materials suitable in principle such as noble metals, tantalum or graphite are not usable for reasons of cost and for industrial reasons.

Therefore it was the problem of the present invention to provide a crucible for containing salt baths for the boriding of steels which are only slightly attatcked by the salt baths and have high "on-stream" times.

Unless otherwise indicated all parts and percentages are by weight.

SUMMARY OF THE INVENTION

This problem has been solved according to the invention by employing as the material for the crucible steels consisting of (or consisting essentially of) 0.05-0.8 wt. % carbon, 0.8-2.5 wt. % silicon, 0.1-2.0 wt. % manganese 6-30 wt. % chromium, 4-39 wt % nickel, 0-1.5 wt. % aluminum, balance iron.

There has especially proven distinguished as crucible material for the boriding salt melts steels of the composition 0.1-0.2 wt. % carbon, 1.9-2.1 wt. % silicon, 0.1-2.0 wt. % manganese, 18-25 wt. % chromium, 10-20 wt. % nickel, balance iron.

In practice there has proven especially good a steel having the composition 0.15 wt. % carbon, 2.0 wt. % silicon, 1.5 wt. % manganese, 20 wt. % chromium, 12 wt. % nickel, balance iron. The work material of the invention which was selected from a large number of known steels possesses an excellent resistance to molten fluoride and borate containing boriding salts. Thus the weight loss of a 350 gram heavy sheet made of a steel containing 0.15 carbon, 2% silicon, 1.5% manganese, 20% chromium and 12% nickel (balance iron) after 520 hours of treatment time in a boriding salt melt at a temperature of 900° C. was only 7 grams or 2% of the weight while a similar carbon steel sheet at the same time of treatment in the same melt was completely destroyed.

DETAILED DESCRIPTION

The following example explains in more detail the advantages of the new crucible material. There was melted at 900° C. in a crucible having the size 18/30 (diameter/depth in cm) made of a steel containing 0.15% carbon, 2% silicon, 1.5% manganese, 20% chromium and 12% nickel (balance iron (a boriding salt bath made of 52 wt. % $BaCl_2$, 18%NaCl, 20% NaF and 10% $B_4C$ and the salt bath was operated continuously for a time span of 2500 hours for treating steel parts. After this time the salt melt was drained out, the inside of the crucible cleaned and inspected. The wall of the crucible showed a light roughening through a relatively slight uniform corrosion attack without the appearance of pitting and deep furrowing of the material.

The entire disclosure of German priority application P 33 28 355.9 is hereby incorporated by reference.

What is claimed is:

1. A crucible suitable for containing a salt bath for the boriding of steel, said crucible being made of a steel consisting of 0.05-0.8 wt. % carbon, 0.8-2.5 wt. % silicon, 0.1-2.0 wt. % manganese, 6-30 wt. % chromium, 0-1.5 wt. % aluminum, 4-39 wt. % nickel, balance iron.

2. A crucible according to claim 1 wherein the steel is free of aluminum.

3. A crucible according to claim 1 made of a steel consisting of 0.1-0.2 wt. % carbon, 1.9-2.0 wt. % silicon, 0.1-2.0 wt. % manganese, 18-25 wt. % chromium, 10-20 wt. % nickel, balance iron.

4. A crucible according to claim 3 made of a steel consisting of 0.15 wt. % carbon, 2.0 wt. % silicon, 1.5 wt. % manganese, 20 wt. % chromium, 12 wt. % nickel, balance iron.

5. A combination consisting of a crucible suitable for containing a salt bath for the boriding of steel, said crucible being made of a steel consisting essentially of 0.05-0.8 wt. % carbon, 0.8-2.5 wt. % silicon, 0.1-2.0 wt. % manganese, 6-30 wt. % chromium, 0-1.5 wt. % aluminum, 4–39 wt. % nickel, balance iron, and a boriding salt bath in the crucible.

6. A combination according to claim 5 wherein the steel consists of 0.1–0.2 wt. % carbon, 1.9–2.0 wt. % silicon, 0.1–2.0 wt. % manganese, 18–25 wt. % chromium, 10–20 wt. % nickel, balance iron.

7. A combination according to claim 6 wherein the steel consists of 0.15 wt. % carbon, 2.0 wt. % silicon, 1.5 wt. % manganese, 20 wt. % chromium, 12 wt. % nickel, balance iron.

8. A combination according to claim 5 wherein the boriding bath contains an alkali or an alkaline earth metal chloride, an alkali or an alkaline earth metal fluoride and boron carbide or boron powder.

* * * * *